US010590517B2

(12) United States Patent
Manuel et al.

(10) Patent No.: US 10,590,517 B2
(45) Date of Patent: Mar. 17, 2020

(54) NICKEL TITANIUM ALLOYS, METHODS OF MANUFACTURE THEREOF AND ARTICLE COMPRISING THE SAME

(71) Applicant: University of Florida Research Foundation, Inc., Gainesville, FL (US)

(72) Inventors: Michele Viola Manuel, Gainesville, FL (US); Derek Hsen Dai Hsu, Portland, OR (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 2 days.

(21) Appl. No.: 15/830,610

(22) Filed: Dec. 4, 2017

(65) Prior Publication Data

US 2018/0094344 A1 Apr. 5, 2018

Related U.S. Application Data

(63) Continuation of application No. 14/552,988, filed on Nov. 25, 2014, now Pat. No. 9,982,330.

(60) Provisional application No. 61/909,681, filed on Nov. 27, 2013.

(51) Int. Cl.

| | |
|---|---|
| ***C22C 30/00*** | (2006.01) |
| ***C22C 27/00*** | (2006.01) |
| ***C22C 1/00*** | (2006.01) |
| ***C22F 1/00*** | (2006.01) |
| ***C22F 1/18*** | (2006.01) |

(52) U.S. Cl.

CPC ..... *C22C 30/00* (2013.01); *C22C 1/00* (2013.01); *C22C 27/00* (2013.01); *C22F 1/006* (2013.01); *C22F 1/18* (2013.01)

(58) Field of Classification Search

CPC . C22C 1/00; C22C 27/00; C22C 30/00; C22F 1/006; C22F 1/18

USPC ..... 148/563

See application file for complete search history.

(56) References Cited

U.S. PATENT DOCUMENTS

| | | | |
|---|---|---|---|
| 5,114,504 | A | 5/1992 | AbuJudom, II et al. |
| 6,592,724 | B1 | 7/2003 | Rasmussen et al. |
| 7,192,496 | B2 | 3/2007 | Wojcik |
| 7,316,753 | B2 | 1/2008 | Jung et al. |
| 8,475,711 | B2 | 7/2013 | Wojcik |
| 2004/0241037 | A1 | 12/2004 | Wu |
| 2009/0178739 | A1 | 7/2009 | Ishida et al. |

OTHER PUBLICATIONS

Derek Hsen Dai Hsu et al. "The Effect of Aluminum Additions on the Shape Memory Behavior of NiTiHf Alloys" University of Florida Presentation, Mar. 3-7, 2013.

Derek Hsen Dai Hsu "Design and Development of NiTi-Based Precipitation-Strengthened High-Temperature Shape Memory Alloys for Actuator Applications" A Dissertation Presented to The Graduate School of The University of Florida; (2013) 148 pages.

Derek Hsen Dai Hsu "Design and Development of NiTi-Based Precipitation-Strengthened High-Temperature Shape Memory Alloys for Actuator Applications" University of Florida Presentation, Jul. 5, 2013 (67 pages).

Derek Hsen Dai Hsu et al. "The Effect of Aluminum Additions on the Shape Memory Behavior of NiTiHf Alloys" University of Florida Presentation, Mar. 2012 (27 pages).

Derek Hsen Dai Hsu, et al. "Investigation of Thermal, Microstructural, and Mechanical Behaviors of NiTiHf Alloys with Aluminum Additions" University of Florida Presentation, Nov. 27, 2012 (24 pages).

*Primary Examiner* — Jie Yang

(74) *Attorney, Agent, or Firm* — Thomas|Horstemeyer, LLP

(57) ABSTRACT

Disclosed herein is a shape memory alloy comprising 48 to 50 atomic percent nickel, 15 to 30 atomic percent hafnium, 1 to 5 atomic percent aluminum; with the remainder being titanium. Disclosed herein too is a method of manufacturing a shape memory alloy comprising mixing together to form an alloy nickel, hafnium, aluminum and titanium in amounts of 48 to 50 atomic percent nickel, 15 to 30 atomic percent hafnium, 1 to 5 atomic percent aluminum; with the remainder being titanium; solution treating the alloy at a temperature of 700 to 1300° C. for 50 to 200 hours; and aging the alloy at a temperature of 400 to 800° C. for a time period of 50 to 200 hours to form a shape memory alloy.

6 Claims, No Drawings

NICKEL TITANIUM ALLOYS, METHODS OF MANUFACTURE THEREOF AND ARTICLE COMPRISING THE SAME

CROSS-REFERENCE TO RELATED APPLICATIONS

This application is a Continuation of U.S. application Ser. No. 14/552,988, filed on Nov. 25, 2014, which claims the benefit of priority to U.S. provisional application No. 61/909,681, filed on Nov. 27, 2013, which are all hereby incorporated herein by reference in their entireties.

STATEMENT REGARDING FEDERALLY SPONSORED RESEARCH & DEVELOPMENT

This invention was made with government support under Contract Number NNX12AQ42G awarded by NASA. The government has certain rights in the invention.

BACKGROUND

This technology addresses an ever-increasing need for high-temperature shape memory alloys (SMAs) operating above 100° C. that is present in aerospace, automotive and power generation industries. Future potential applications for the newly developed high-temperature SMAs include shape-morphing structures, actuators and valves for airplanes and vehicles, and oil and gas exploration components. This innovation can be implemented into current aerospace applications including variable geometry chevron, variable area fan nozzle, and reconfigurable rotor blade that reduce noise and increase fuel economy by using high-temperature SMA actuators to adapt to changing flight conditions.

SUMMARY

Disclosed herein is a shape memory alloy comprising 48 to 50 atomic percent nickel, 15 to 30 atomic percent hafnium, 1 to 5 atomic percent aluminum; with the remainder being titanium.

Disclosed herein too is a method of manufacturing a shape memory alloy comprising mixing together to form an alloy nickel, hafnium, aluminum and titanium in amounts of 48 to 50 atomic percent nickel, 15 to 30 atomic percent hafnium, 1 to 5 atomic percent aluminum; with the remainder being titanium; solution treating the alloy at a temperature of 700 to 1300° C. for 50 to 200 hours; and aging the alloy at a temperature of 400 to 800° C. for a time period of 50 to 200 hours to form a shape memory alloy.

DETAILED DESCRIPTION

A nickel-titanium-hafnium-aluminum shape memory alloy (NiTiHfAl) SMA with the optimum Heusler precipitate size corresponding to peak aging conditions will demonstrate longer fatigue life, improved strength and output stress, and increased transformation temperature, which demonstrates a significant improvement in properties and expansion in applications. This innovation provides a systems approach that combines thermodynamic design with advanced characterization techniques to facilitate the accelerated development of precipitation-strengthened high-temperature SMAs and propel transformative advancement in this field. In regards to immediate impact, this technology will serve as a strong foundation for fundamental knowledge and design parameters on NiTiHfAl SMAs that other researchers can use to optimize alloys for commercial and industrial applications. In the future, the long-term vision is that this same design methodology can be applied to similar SMA systems, eventually enabling the generation of a database with SMAs of customizable mechanical properties and transformation temperatures adapted for specific applications.

This technology details a nickel-titanium (NiTi)-based, precipitation-strengthened, high-temperature shape memory alloy (SMA). The alloy microstructure comprises a nickel-titanium Ni—Ti matrix with hafnium (Hf) and aluminum (Al) additions, strengthened by stable and coherent $Ni_2TiAl$ Heusler nanoprecipitates. The Hf addition to NiTi increases the transformation temperatures, while the Al addition allows for the precipitation of the strengthening phase. This combination results in increased alloy strength as well as high operating temperatures. The alloy is designed with a two step heat treatment:

1) solution-treatment at a higher temperature to obtain a supersaturated Ni(Ti, Hf, Al) matrix, and
2) aging treatment at a lower temperature to precipitate the strengthening Heusler phase. This innovation encompasses a thermodynamically-driven systems approach to design the aforementioned SMAs that can be applied to different systems other than NiTi-based alloys.

The nickel-titanium-hafnium-aluminum shape memory alloy can comprise 48 to 50 atomic percent nickel, 15 to 30 atomic percent hafnium, 1 to 5 atomic percent aluminum with the remainder being titanium. In an exemplary embodiment, the shape memory alloy has the formula $Ni_{50}Ti_{(30-x)}Hf_{20}Al_x$, where x can have a value of up to about 5. In an embodiment, the number 'x' can have values of 0, 1, 2, 3, 4, or 5.

For a solution-treated nickel-titanium-hafnium-aluminum shape memory alloy having up to 2 wt % aluminum (based on the total weight of the nickel-titanium-hafnium-aluminum shape memory alloy), the compressive strength values were 900 to 1200 MPa, specifically 1000 to 1150 MPa at approximately 1.5 to 5% compressive strain, specifically 2.5 to 4.5% compressive strain. During unloading the nickel-titanium-hafnium-aluminum shape memory alloys having up to 2 wt % aluminum showed a residual strain of up to 1.7%. The stress-strain behavior of these alloys under compressive stress indicates that they are in the martensitic state at the start of testing.

For the nickel-titanium-hafnium-aluminum shape memory alloys having greater than 2 wt % aluminum and less than 5 wt % aluminum based on the total weight of the nickel-titanium-hafnium-aluminum shape memory alloy, the stress-strain behavior is indicative of a transition state between the martensite and austenite phases at the testing temperature. For the 4 and 5 wt % aluminum alloys, the behavior confirms that the transformation temperatures of these alloys are below room temperature. It can also be concluded that precipitates formed during the aging process increased the strength of the alloys once the solubility limit of approximately 3% Al has been reached. Both Heusler and Han phase precipitates that strengthen the alloy were observed in the 3, 4, and 5% Al alloy with precipitates sizes from 1-10 nm. Depending on the composition, transformation temperatures ranged from 315 to −60° C.

The alloy can be produced by taking powders of nickel, titanium, aluminum and hafnium in the desired proportions and induction melting them or arc melting them to produce the alloy. It can be solution treated to obtain a supersaturated matrix. The alloy is solution treated at a temperature of 700 to 1300° C., specifically 800 to 1000° C. for 50 to 200 hours, specifically 75 to 150 hours. In an exemplary embodiment, the alloy was solution treated at a temperature of 950° C. for 100 hours.

The alloy is then aged at 400 to 800° C., specifically 550 to 650° C. for a time period of 50 to 200 hours, specifically 75 to 125 hours to form the shape memory alloy.

The shape memory alloy was characterized using differential scanning calorimetry, optical microscopy, x-ray diffraction, compression testing and transmission electron microscopy.

What is claimed is:

1. A shape memory alloy comprising nickel (Ni), hafnium (Hf), aluminum (Al), and titanium, where the shape memory alloy has the formula $Ni_{50}Ti_{(30-x)}Hf_{20}Al_x$, where x has a value of 2 to 5, where the alloy displays a compressive strength of 900 to 1200 MPa at a compressive strain of 1.5 to 5%.

2. The shape memory alloy of claim 1, where x has values of 2, 3, 4, or 5.

3. The shape memory alloy of claim 1, where the titanium is present in an amount of 25 to 30 atomic percent.

4. The shape memory alloy of claim 1, where the alloy has precipitates of 1 to 10 nanometers.

5. The shape memory alloy of claim 1, where the shape memory alloy has the formula $Ni_{50}Ti_{(30-x)}Hf_{20}Al_x$, where x has a value of 3 to 5.

6. The shape memory alloy of claim 1, where x has values of 4 or 5.

* * * * *